US005623110A

United States Patent [19]

Hoglund et al.

[11] Patent Number: 5,623,110

[45] Date of Patent: Apr. 22, 1997

[54] QUICK-SETTING, VARIABLE, CHORD-FORMING, PARTIAL CAPO

[76] Inventors: Steven G. Hoglund, 1501 E. Broadway; Wayne A. Cox, 306 E. 4th St., both of Monticello, Minn. 55362

[21] Appl. No.: 568,203

[22] Filed: Dec. 6, 1995

[51] Int. Cl.[6] ..... G10D 3/00

[52] U.S. Cl. ..... 84/318

[58] Field of Search ..... 84/318, 317, 316, 84/315

[56] References Cited

U.S. PATENT DOCUMENTS

| | | | |
|---|---|---|---|
| 468,193 | 2/1892 | Dahlman et al. | 84/318 |
| 2,961,913 | 11/1960 | Popkin | 84/455 |
| 3,011,380 | 12/1961 | Brimhall | 84/317 |
| 3,680,427 | 8/1972 | Valentino | 84/456 |
| 3,995,523 | 12/1976 | Clarke | 84/317 |
| 4,183,279 | 1/1980 | Shabram, Jr. | 84/318 |
| 4,195,546 | 4/1980 | Urbank | 84/318 |
| 4,334,457 | 6/1982 | Spoonts, III | 84/318 |
| 5,431,080 | 7/1995 | Wiesenthal | 84/318 |

OTHER PUBLICATIONS

"Tuning In" by James Jensen, Acoustic Guitar Nov./Dec., 1994.

Feature story on New Products, including capos, appearing in Acoustic Oct. 1995, No. 34 pp. 48–54, especially pp. 51–53. Author unknown.

*Primary Examiner*—Michael L. Gellner

*Assistant Examiner*—Shihyung Hsieh

*Attorney, Agent, or Firm*—Larry M. Jennings, P.A.

[57] ABSTRACT

A capo is disclosed that allows a musician to selectively engage any of the strings of a stringed musical instrument that has a neck and fingerboard. Multiple string contacting portions that can slide transversely to the neck of the musical instrument are provided. In addition, the pressure bar that applies pressure to the string contacting portions of the capo can slide transversely to the strings so that when fewer than all of the strings are to be engaged by the capo, it may be possible to remove the capo from the area in which the musician would desire to place the fingers in order to create the desired note. This capo is designed to allow the musician to straddle the capo with the fingers of the hand in order to play any note available on the instrument and to provide maximum flexibility in chord selection. The capo is designed to allow the musician to select from all possible combinations of capo and string engagement at each fret; there are 63 possible note combinations at each fret of a six stringed instrument.

20 Claims, 2 Drawing Sheets

QUICK-SETTING, VARIABLE, CHORD-FORMING, PARTIAL CAPO

TECHNICAL FIELD

The present invention is related to accessories for musical instruments generally and to fretted stringed musical instruments in particular. Specifically, the present invention is a new type of capo tasto, also known as a capo. A capo is used to raise the pitch of a musical instrument such as a guitar, banjo, mandolin, or the like. Conventional capos are often made of a steel cylinder, tube or padded T-bar that extends transversely across the strings and fretted fingerboard (fretboard) of the musical instrument. An elastic strap may be affixed to one end of the capo bar, passed behind the neck of the instrument and connected to the other end of the capo bar. The elastic strap biases the capo bar against the strings causing all of the strings of an instrument to come into contact with a single fret.

Of the factors affecting the pitch produced by a vibrating string of a musical instrument, it is the length of the string that is normally varied by the musician performing with a fretted stringed instrument. Musicians use their fingers to bring strings of an instrument into contact with a fingerboard and/or frets. Shortening the length of the portion of a string that is allowed to vibrate raises the pitch of the sound produced by an instrument.

Fretted stringed instruments typically have a sound box and an elongated neck extending from the sound box. Guitars, mandolins and banjos are among the familiar fretted stringed musical instruments although the classification includes many other instruments such as lutes and viols which were popular before the end of the eighteenth century. A fretted fingerboard enables sustained notes from a single pluck of a string by reducing the damping effect of the fingers on string vibration. The frets also make it easier for the musician to effect desired discrete changes of pitch by establishing with certainty the length of the vibrating portion of the string rather than relying exclusively on the instrumentalist's ability to place the fingers against the fingerboard and string at exactly the desired position.

Strings run above the fingerboard and frets, to the end of the sound box opposite the neck. A string retaining bridge holds the strings in alignment above the sound box and fingerboard and communicates the vibrations of the strings to the sound board. The sound board is the side of the sound box facing the strings. A nut extends transversely across the end of the neck opposite the sound box. The strings fit into grooves formed in the nut and are thus held in alignment at the correct clearance above the fingerboard and guided to string tensioning mechanisms. The string tensioning mechanisms are used to tune the instrument, usually before it is played.

When playing the instrument, the musician can raise the pitch produced by a string by bringing it into contact with one of the frets disposed transversely on the elongated fingerboard. Specific musical techniques and effects may be more easily rendered in one key than another. In addition, musicians may vary the tuning of an instrument to obtain desired effects. A capo provides a means for quickly altering the pitch of a fretted stringed musical instrument. The present capo can be used in standard tuning or altered tuning of an instrument.

BACKGROUND ART

The addition of a capo allows a musician to quickly alter the pitches produced when unfingered strings are strummed.

A traditional capo raises the pitch of each string by bringing all strings into contact with the selected fret. A musician may also alter the tuning of one or more strings after installation of a capo to obtain desired playing characteristics. Once affixed to an instrument, the traditional capo severely limits the selection of notes that it is possible for the instrument to produce because notes cannot be produced by the portions of the strings cut off by the capo.

U.S. Pat. No. 4,183,279 to Shabram discloses a variable chord-forming capo attached by a strap to the neck of the instrument. In operation, eccentric disks may be rotated to engage or disengage from each string. Both the Shabram partial capo and the capo disclosed in U.S. Pat. No. 4,334,457 to Spoonts appear to be somewhat time-consuming to set and adjust. Although any open string might be fingered on either side of the installed Shabram capo, neither Shabram nor Spoonts disclose features designed to facilitate fingering of strings above as well as below the capo. The size of the eccentric disks would make it difficult to position the fingers to fret strings near the Shabram capo, especially when it is desired to simultaneously fret strings both above and below the capo.

A further limitation on the types of capos disclosed by Spoonts and Shabram results from the fact that the strings of a stringed instrument are separated by distances that are neither uniform among instruments nor constant for any given instrument. Strings are often spaced farther apart at the bridge than at the nut. In order to engage the strings at any point along the neck of an instrument, a partial capo must allow transverse adjustment of the string engaging elements. The Spoonts capo provides no transverse adjustment of string engaging elements. The requirement that the Shabram string engaging elements be rotatable precludes simple interlocking string engaging element forms. A string that a musician desired to depress with the capo could instead slip into the gap between adjacent disks. Should a slightly misaligned string slip between adjacent string engaging elements during performance, it might be necessary to halt playing, remove ;the capo, re-adjust it, and re-install it.

A popular embodiment of a traditional capo is disclosed in U.S. Pat. No. 4,583,440 to Powell. A steel spring is used to bias the two arms or jaws of a clamp toward one another. Powell discloses a stepped underside for the string engaging portion of the upper clamp member for allowing the capo to be used on a five-string banjo. U.S. Pat. No. 5,431,080 to Wiesenthal discloses a capo that has many of the functional and convenience features of the Powell capo, such as being operable with one hand. However, Wiesenthal uses a cam instead of a spring to bias the string engaging member toward the fretboard.

U.S. Pat. No. 4,195,546 to Urbank discloses a chord selector that could effect some of the functionality of a partial capo. However, the Urbank device can be used to bring strings into contact with only frets that are close to the nut. Because the string-depressing arms disclosed by Urbank extend above each string from the head of the instrument to the contacted fret, it would be difficult for a musician to finger strings adjacent to the chord-forming arms of the Urbank invention. In recent years, guitars have become increasingly popular among musicians. As more people have developed an interest in making music with the guitar, interest in advanced techniques for tuning and playing has also grown. One explanation of the growing interest in technique is that musicians need to perform at a higher standard than ever before because low levels of skill are less acceptable among audiences that have become accustomed to musical excellence as the result of the widespread availability of high quality recorded music. By proper use of a capo, musicians may be able to execute musical performances that they would otherwise be unable to accomplish. Forming certain bar chords might, for example, be beyond the abilities of a musician. Using a capo could make it possible for that person to play such chords.

A partial capo, by engaging fewer than all strings with a selected fret, enables a musician to form chords and sequences of notes that would be difficult or impossible to play otherwise. A partial capo allows a musician to easily set and play drone notes on instruments other than the five-string banjo. In order to fully exploit the potential of using a partial capo, however, it is necessary to manipulate strings on both sides of the installed capo. Previously known capos hinder the musician who wishes to engage strings with frets situated on both sides of the capo.

What is needed, then, is a capo that poses a minimal obstruction when installed on the neck of a stringed instrument. The capo needs to have a low profile in order to allow the musician's fingers to clear the capo when the hand is moved along the neck of the instrument. Moreover, adjustment of the capo bar is needed so that it extends over no more strings than necessary. The capo must be capable of engaging any combination of strings with the selected fret without over-stretching and detuning any string. Finally, it must be possible to quickly and easily configure the capo and engage the desired strings with it.

DISCLOSURE OF THE INVENTION

The capo disclosed below overcomes the limitations of previously known capos. Applicant believes this is the first capo that allows musicians to fully exploit the techniques made possible by partial capos. It can bring all or any combination of strings into contact with a selected fret. The low profile and retractable pressure bar of this capo make it much easier for a musician to finger strings in the vicinity of the capo. The capo is designed to avoid over-stretching strings and de-tuning them. It is easily used and quickly adjusted, installed or removed.

Although it is anticipated that the present capo would more frequently be used with fretted stringed instruments, it can readily be used with instruments that have no frets. It may be desirable to reduce the damping effect of the string depressors when the capo is used with unfretted instruments. Replacing the usual resilient string depressors with others composed of harder material may yield improved volume, better tone and longer sustain periods when the capo is used on instruments having unfretted fingerboards.

The capo attaches at the desired location on the neck of a fretted musical instrument such as a guitar or banjo with a simple, one-handed, motion. String engaging elements (string depressors) are moveably attached to a sliding bar disposed across the front of the fingerboard and strings. The sliding bar attaches to a frame or receiver, as does a clamp arm and the handles. A manually-releasable biasing means such as elastic, screw threads, eccentric, cam, wedge or, preferably, a steel spring, biases the clamp arm against back side of the neck of the instrument opposite the strings. That bias urges the sliding bar on which string depressors are mounted toward the strings causing the string depressors to engage the strings with the fret. Prior to attaching the capo, the musician can select which strings will be depressed by sliding string depressors longitudinally on the bar to the desired positions. The string depressors may be retained at the desired settings by friction, detents, springs, magnetic or any other suitable means.

Compared to previous disclosures, the lower profile of the present capo makes it easier for a musician to straddle the capo with the fingers of the fretting hand. Fingering the strings is also made easier because the bar and the clamp arm preferably remain open on the side of the neck closer to the musician's fretting hand.

The present capo is called a partial capo because it can engage all or fewer than all strings with a fret. Unlike other capos, the bar of the present capo is adapted for sliding. The sliding bar may be adjusted to extend over only the strings necessary, thereby reducing the interference of the capo with the musician's fingering of the strings. A locking mechanism comprised of a set screw, cam or any other suitable means may be used to hold the bar at a desired location. It is also possible to hold the bar within the slide-way of the receiver by a suitable friction fit. The advantage of a capo that extends over the fingerboard only so far as necessary is multiplied if more than one capo is used. It is to be appreciated that the present invention may be used in configurations having as many capos as there are strings on the instrument when each capo is engaged with only one string. It is further to be understood that there are many combinations of string engagement possible. On a six-string guitar, for example, it is possible to obtain sixty-three different combinations of string engagement with every fret.

In one preferred embodiment the string depressors are made with incrementally increasing widths. The strings of most stringed instruments are spaced more widely at the bridge than at the nut. If the width of the string depressors are all equal, it would be difficult to avoid having one or more strings situated at the gap between two string depressors at some location on the fingerboard. The result would probably be an unpleasantly muffled sound from the string.

The string engaging portions of the string depressors may optionally be made with interlocking shapes. When it is desired to bring adjacent strings into contact with a fret, interlocking shaped string depressors may reduce the tendency of a string to slip between adjacent moveable string depressors. The string engaging surfaces may display any of several interlocking shapes including, without limitation, tongue and groove, zig-zag, ship lap, dove-tail, to suggest a few.

As a further refinement of the string depressor shape, it is to be understood that in some preferred embodiments, the string-contacting portion of the string depressors may be parallelepiped shapes. By making the lowermost portion of the string depressors extend toward the center of the fretboard, it may be possible for a string depressor stabilize the bar. If the string depressor extends from the slide bar, past one of the strings closest to the edge of the fingerboard, angles toward the center of the fingerboard and then contacts the fingerboard the bar may be stabilized without the necessity of adding a separate stabilizing element.

The present invention optionally provides stabilizers that contact the neck or fingerboard to counter any tendency of the capo to rotate about the longitudinal axis of the neck when it is desired to depress only strings that are close to one edge of the fingerboard. Other design elements may also provide the necessary stability. For instance, the string engaging material and/or the neck engaging pad may be fashioned to provide adequate stability without additional stabilizing elements on many, if not all, instruments.

Similarly, the optional stabilizers or other, separate limiters can optionally be configured to prevent the pressure applied by the string depressors from excessively deflecting the string thereby de-tuning the string. De-tuning can result when a capo applies sufficient force to stretch the string excessively toward the fingerboard. Many different combinations of string depressor size, string depressor shape, string depressor resilience and bar biasing can appropriately limit string stretching and resultant detuning. No further adjustment of stabilizers and/or other means for limiting string deflection will normally be required after the capo has been adapted to a particular instrument.

Fluorescent, phosphorescent, luminescent, high contrast or other enhanced visibility indicia may optionally be included in the present capo to facilitate setting the string depressors in conditions of low light.

BEST MODE FOR CARRYING OUT THE INVENTION

Figure 1:
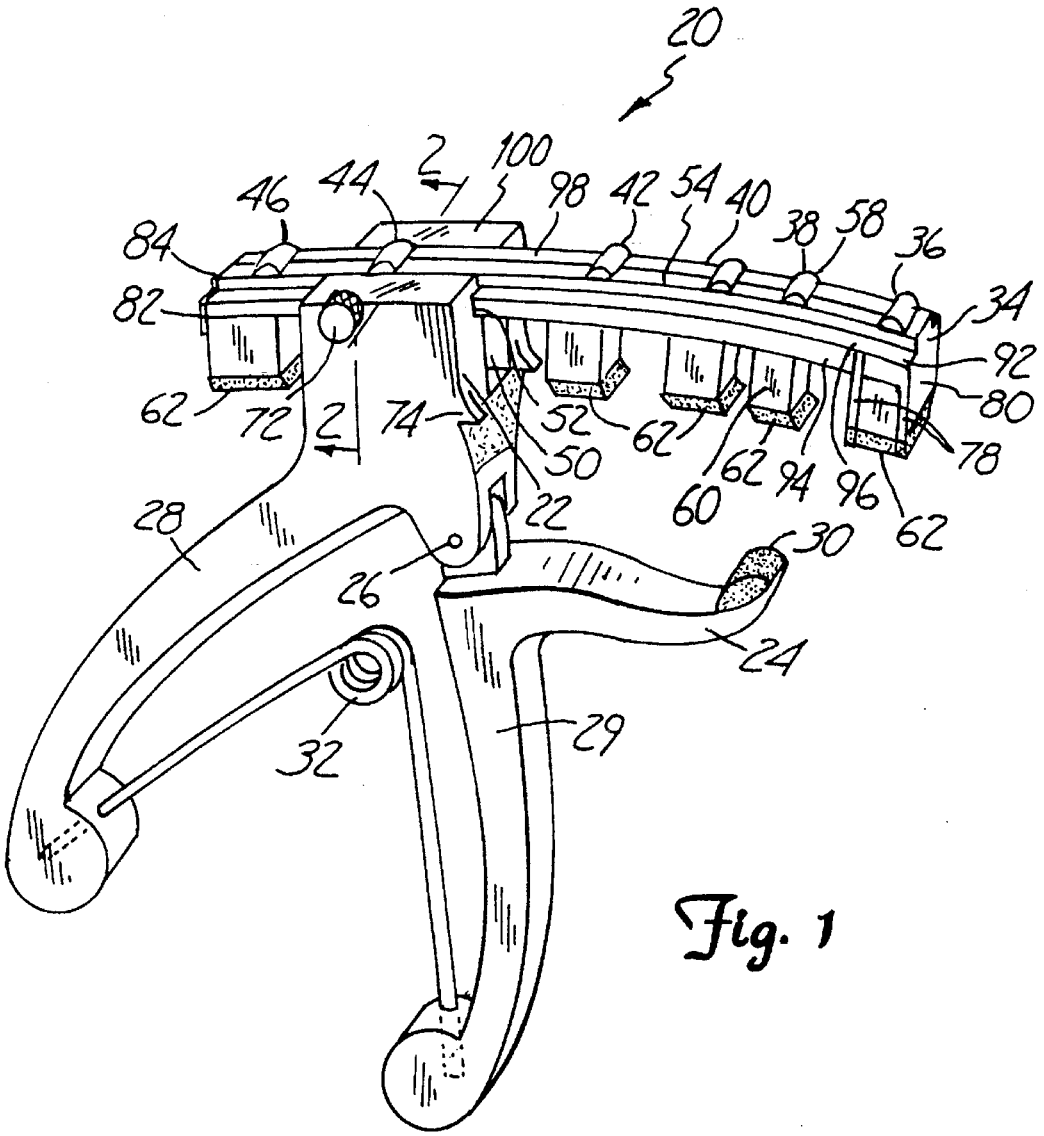
FIG. 1 is a perspective view of a preferred embodiment of the invention.

Referring now to FIG. 1, there is shown a perspective view of a preferred embodiment of the quick-setting, variable, chord-forming partial capo 20. The capo 20 is comprised of a receiver 22 to which a clamp arm 24 is moveably attached by a hinge 26. A receiver handle 28 extends from the receiver 22, preferably toward the rear and spaced apart from the clamp handle 29 so that the two handles may be operatively gripped by one hand of the person using the capo 20. A pad 30 may be included with the inner surface of the clamp arm 24 to prevent marring the finish of a musical instrument. Spring 32 or other biasing means biases the receiver handle 28 apart from the clamp handle 29 which acts to bias the clamp arm 24 toward the string depressor slide bar 34 which contains a first string depressor 36, and preferably, a second string depressor 38, a third string depressor 40, a fourth string depressor 42, a fifth string depressor 44 and a sixth string depressor 46, as illustrated. More generally, the typical string depressor 48 may be referred to instead of any particular string depressor. It is to be understood that any number of string depressors may be used and that the string depressors 48 may have different sizes and shapes.

Figure 2:
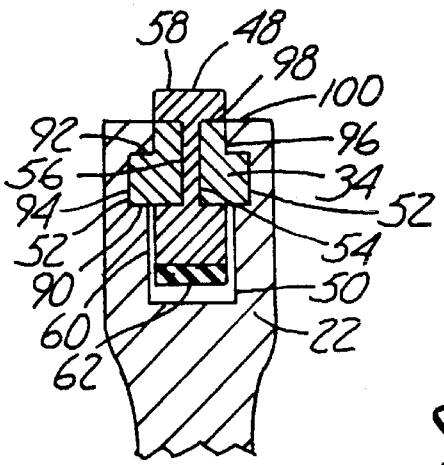
FIG. 2 is a cross-section taken along line 2—2 of the embodiment depicted in FIG. 1.

Referring now to FIG. 2, in which a cross-section of the receiver 22 taken at line 2—2, more clearly depicts the passageway 50 through which the string depressors 48 may be moved in accordance with the needs of the musician. Formed within the passageway 50 is a slideway 52 that slideably engages the string depressor slide bar 34. A slot 54 extends most of the length of the string depressor slide bar 34 through which the medial portion 56 of the string depressor 48 extends.

Figure 3:
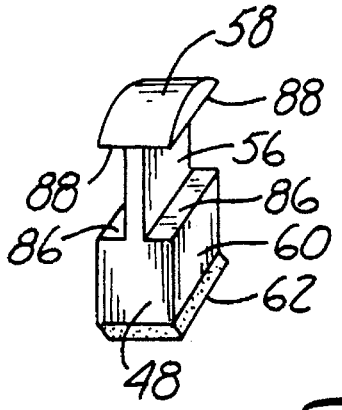
FIG. 3 is a perspective detail of a representative string depressor.

In FIG. 3, a preferred configuration of the string depressor 48 is shown in perspective. The medial portion 56 of the string depressor connects the top portion 58 of the string depressor 48 with the bottom portion 60 of the string depressor 48. The bottom portion 60 may be terminated with a string contacting portion 62 configured of a different shape and/or material than the other portions of the string depressor 48.

Figure 4:
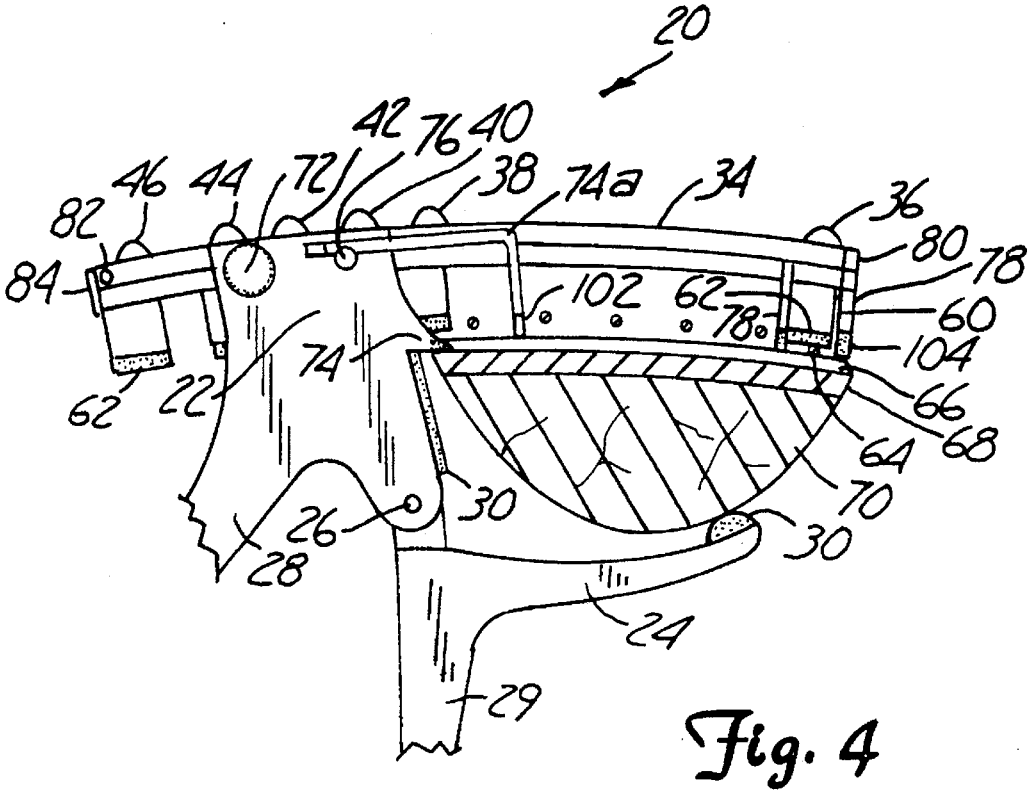
FIG. 4 is a side elevation of the embodiment shown in FIG. 1 fitted for use on the neck of a fretted stringed musical instrument.

FIG. 4 shows the string contacting portion 62 of the first string depressor 36 engaging a string 64 with a fret 66 that extends upwardly from the fingerboard 68 which is affixed to the neck 70 of a stringed musical instrument. An optional slide lock 72 may be used to prevent undesired movement of the slide bar 34. Although the lock shown is of the setscrew type, any suitable means may be used to prevent unwanted movement including, without limitation, captive bolt, captive pin, spring catch, ball catch, cam, friction, spring, fluid, etc.

An optional inboard stabilizer 74 or 74*a* may engage the fingerboard 68 or neck 70 in response to the bias exerted by clamp arm 24. If an optional inboard stabilizer of the pin type 74*a* is used, it maybe fitted with an inboard stabilizer lock 76 to allow the capo 20 to be fitted to a particular instrument. If an optional inboard stabilizer of the ledge type 74 is used, it may be angled to accommodate the taper of the neck 70. Similarly, an outboard stabilizer 78, either with or without a separate locking mechanism analogous to the inboard stabilizer lock 76 may be incorporated into the capo 20. In the preferred embodiment, the outboard stabilizer 78 may contact the fingerboard 68 on either or both sides of the string 64 most distant from the receiver 22 which is to be engaged by a string depressor 48. The slide bar 34 may be fitted with an outboard end cap 80 which may also function as the outboard stabilizer 78. One purpose of the stabilizers 74 and 78 is to minimize any tendency of the capo 20 to rotate about the longitudinal axis of the neck 70 when few strings 64 are engaged by the string depressors 48.

A stop 82 may be included to prevent the slide bar 34 from falling out of the slide way 52 during installation, adjustment or removal of the capo 20. An inboard end cap 84 on the end of the slide bar 34, like the outboard end cap 80 may optionally be removable to facilitate installation or replacement of string depressors 48.

FIG. 2 and FIG. 3 further illustrate one preferred embodiment of a string depressor 48 showing the shoulder 86 and the top inner surface 88 of the string depressor 48. The bottom surface 90 of the slide bar 34 is urged against the shoulder 86 of the string depressor 48 when the capo 20 is engaged with the neck 70 of a musical instrument. The bar retainer surface 92 transmits the downward bias from the receiver 22 that is communicated to the string depressors 48. The bar outer surface 94 and bar extension surface 96 are generally perpendicular to the bar bottom surface 90, the bar retainer surface 92 and the bar top surface 98. The receiver top surface 100 is preferably on substantially the same plane as the bar top surface 98.

FIG. 4 offers a view of the inboard stabilizer pad 102 of one embodiment and the outboard stabilizer pad 104 which are optionally provided to prevent marring of the surface of the fingerboard.

INDUSTRIAL APPLICABILITY

The industrial applicability of the present invention is readily seen from the foregoing description and the appended claims.

Changes and modifications in the specifically described embodiments can be carried out without departing from the scope of the invention which is intended to be limited only by the scope of the appended claims.

COMPONENT REFERENCE NUMBERS

20. quick-setting, variable, chord-forming partial capo

22. receiver

24. clamp arm

26. hinge

28. receiver handle

29. clamp handle

30. pad

32. spring or other biasing means (to bias receiver handle 28 apart from clamp handle 29)

34. string depressor slide bar

36. first string depressor

38. second string depressor

40. third string depressor

42. fourth string depressor

44. fifth string depressor

46. sixth string depressor

48. typical string depressor

50. passageway through receiver 22

52. slide way for sliding string depressor slide bar 34 through receiver 22

54. slot through sliding string depressor slide bar 34

56. medial portion of typical string depressor 48

58. top portion of typical string depressor 48

60. bottom portion of typical string depressor 48

62. string contacting portion of typical string depressor 48

64. string

66. fret

68. fingerboard

70. neck

72. slide lock for fixing the position of string depressor slide bar 34

74. inboard stabilizer

76. inboard stabilizer lock

78. outboard stabilizer

80. outboard end cap

82. stop for string depressor slide bar 34

84. inboard end cap

86. shoulder of typical string depressor 48

88. top inner surface of typical string depressor 48

90. bar bottom surface (of bar 34)

92. bar retainer surface (of bar 34)

94. bar outer surface (of bar 34)

96. bar extension surface (of bar 34)

98. bar top surface (of bar 34)

100. top surface of receiver 22

102. inboard stabilizer pad

104. outboard stabilizer pad

I claim:

1. A partial capo for depressing the strings of a musical instrument of the type having a neck and strings, comprising:

a. a receiver, b. a bar adjustably attached to said receiver, said bar being adjustably extendible across a plurality of said strings, c. a plurality of string depressors attached to said bar, said string depressors selectively engageable with said strings, d. biasing means for biasing said string depressors against said strings, and e. a clamp for removably clamping said receiver proximate to said neck.

2. A partial capo as defined in claim 1 wherein said bar is longitudinally slidably attached to said receiver.

3. A partial capo as defined in claim 2 wherein said string depressors are longitudinally slidably attached to said bar.

4. A partial capo as defined in claim 3 wherein said bar is selectably extendible over fewer than all of said strings.

5. A partial capo as defined in claim 4 wherein said receiver has a slide way formed therein, said slide way being adapted to allow said bar to slide longitudinally within said receiver along substantially the length of said bar.

6. A partial capo as defined in claim 5 wherein said receiver has a passageway formed therein, said passageway being adapted to allow said string depressors to slide longitudinally along substantially the length of said bar.

7. A partial capo as defined in claim 6 wherein said biasing means for biasing said string depressors against said strings is comprised of a spring.

8. A partial capo for depressing the strings of a musical instrument of the type having a neck, a fretted fingerboard and strings, comprising:

a. a receiver having, i. a top surface, ii. a receiver handle extending generally oppositely from said top surface, iii. a hinge situated generally oppositely from said top surface and proximate to said receiver handle, b. a clamp handle pivotably attached to said hinge, c. a clamp arm engageable with said neck extending from said clamp handle generally parallel to and spaced apart from, d. a bar slidably engageable with said receiver, said bar further comprising;

i. a bar top surface oriented generally parallel to the plane defined by said receiver top surface, ii. a bar bottom surface generally opposite said bar top surface, iii. a plurality of selectably string engaging string depressors extending from said bar bottom surface toward said clamp arm, e. biasing means for biasing said clamp arm against said neck and simultaneously engaging said string depressors with said strings.

9. A partial capo as defined in claim 8 wherein said biasing means for biasing said clamp arm against said neck is comprised of a spring.

10. A partial capo as defined in claim 9 wherein:

a. a longitudinal slot communicating between said bar top surface and said bar bottom surface extends substantially the length of said bar, b. said string depressors are longitudinally slidably engaged with said bar.

11. A partial capo as defined in claim 10 wherein each string depressor is further comprised of:

a. a top portion having a top inner surface adapted for disposition proximate to said bar top surface, b. a bottom portion having a shoulder adapted for contacting said bar bottom surface, and c. a medial portion connecting said bottom portion and said top portion, said medial portion extending generally perpendicular to the longitudinal axis of said bar, through said bar longitudinal slot.

12. A partial capo as defined in claim 11 wherein said receiver has a passageway through which said string depressors may be selectively slid, said passageway being aligned with the longitudinal axis of said bar.

13. A partial capo as defined in claim 12 having means for limiting string depressor string deflection.

14. A partial capo as defined in claim 13 having means for stabilizing said bar.

15. A partial capo as defined in claim 12 having a fingerboard-contacting outboard stabilizer.

16. A partial capo as defined in claim 12 having a fingerboard-contacting inboard stabilizer.

17. A partial capo for depressing the strings of a musical instrument of the type having a neck, a fretted fingerboard and strings, comprising:

a. receiver mountable upon said musical instrument neck proximate to said fretted fingerboard, i. a bar engaged with said receiver, said bar extendable above and adjustably transversely across at least a portion of said fretted fingerboard, ii. a plurality of slidable string depressors attached to said bar between said bar and said strings, each of said string depressors having, (1) a top portion, (2) a bottom portion, (3) a medial portion disposed within said longitudinal slot of said bar, said medial portion connecting said string depressor top portion to the bottom portion of said string depressor, and (4) a string-contacting portion, b. a clamp arm moveably connected to said receiver opposite said string-depressor string-contacting portions, c. biasing means for releasably biasing said clamp arm toward said string-contacting portions of said string depressors.

18. A partial capo as defined in claim 17 wherein said receiver has a passageway formed therein through which said slidable string depressors may selectably be slid.

19. A partial capo as defined in claim 18 wherein a. said bar is longitudinally slidably engaged with said receiver, and b. said string contacting portions of said string depressors are formed in graduated lengths.

20. A partial capo as defined in claim 17 wherein:

a. a slide way is formed in said receiver, said slide way being adapted for sliding said bar longitudinally through said receiver, b. said receiver has a passageway formed in alignment with said slide way, said passageway being adapted to allow said string depressors to be selectably slid along said bar, c. at least one musical instrument fingerboard-contacting stabilizer is attached to said receiver, d. said bar is formed to correspond generally parallel to curvature of said fingerboard, and e. locking means selectably prevents movement of said bar with respect to said receiver.

* * * * *